United States Patent [19]

Wilbur

[11] 3,941,303

[45] Mar. 2, 1976

[54] SHIPPING CASE

[75] Inventor: Charles J. Wilbur, Barrington, Ill.

[73] Assignee: The Quaker Oats Company, Chicago, Ill.

[22] Filed: Feb. 27, 1975

[21] Appl. No.: 553,667

[52] U.S. Cl. ..... 229/37 E; 229/44 R

[51] Int. Cl.[2] ..... B65D 5/02

[58] Field of Search ..... 229/37 R, 37 E, 38, 39 R, 229/44 R, 45, 3.1

[56] References Cited

UNITED STATES PATENTS

| | | | |
|---|---|---|---|
| 1,211,857 | 1/1917 | Johnson | 229/37 R X |
| 1,223,232 | 4/1917 | Ash | 229/37 R |
| 3,007,376 | 11/1961 | Hickin et al. | 229/37 R X |
| 3,356,278 | 12/1967 | Layne, Sr. | 229/37 R X |
| 3,357,629 | 12/1967 | Smith | 229/37 R |
| 3,362,614 | 1/1968 | Farquhar | 229/37 R |
| 3,519,194 | 7/1970 | Kohlhaas et al | 229/37 R X |
| 3,743,167 | 7/1973 | Russell | 229/45 X |

*Primary Examiner*—Davis T. Moorhead
*Attorney, Agent, or Firm*—Joseph P. O'Halloran

[57] ABSTRACT

Tops of corrugated shipping cases are routinely severed for price marking of package contents, and this process incurs substantial cutting of contents, e.g., cereal packages and the like. A corrugated shipping case is disclosed which substantially eliminates this kind of damage to the contents. In accordance with the present invention, the shipping case includes a top panel positioned adjacent the tops of the packaged contents, which top panel includes dependent flaps extending downwardly along at least three sides of the package, the dependent flaps being free of any connection to the body along the entire edge adjacent the top panel, and being attached to the body of the case beyond the cutting zone. In addition, one of the flaps is formed by an S fold of the corrugated material at the top of a side panel, immediately adjacent the top panel.

7 Claims, 12 Drawing Figures

FIG. 10
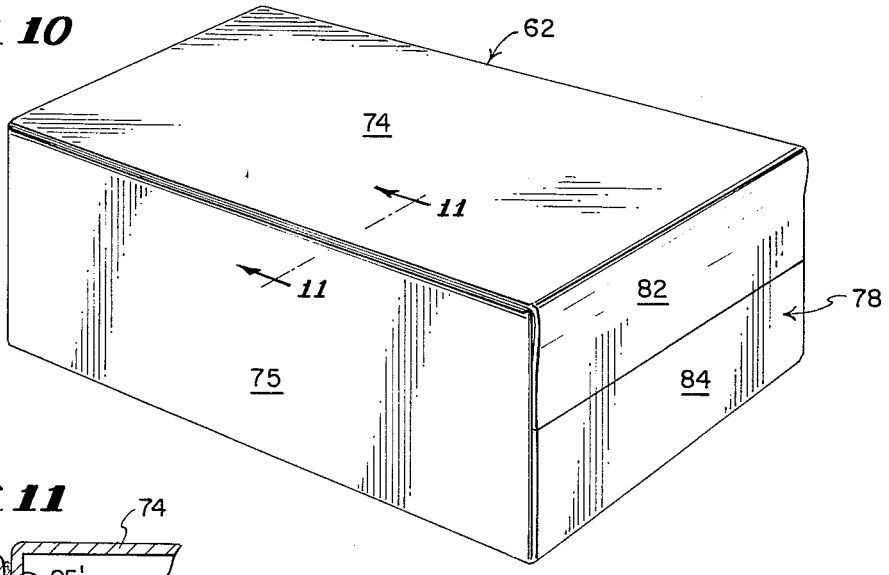
FIG. 11
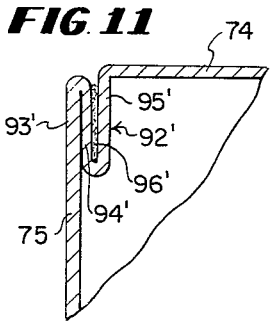
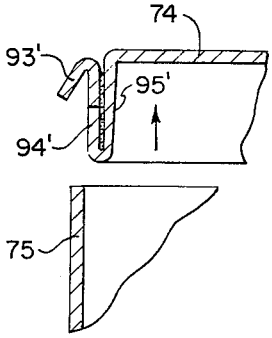
FIG. 12
FIG. 8
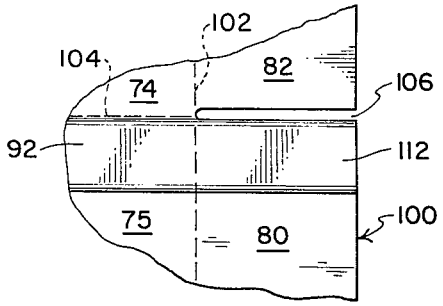
FIG. 7
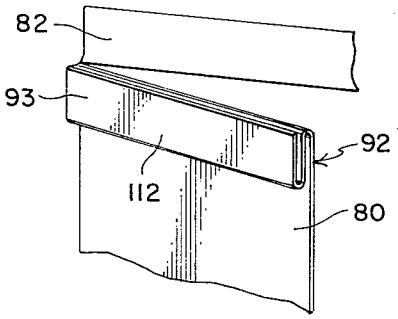
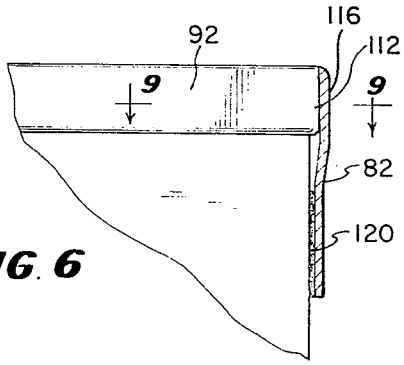
FIG. 6
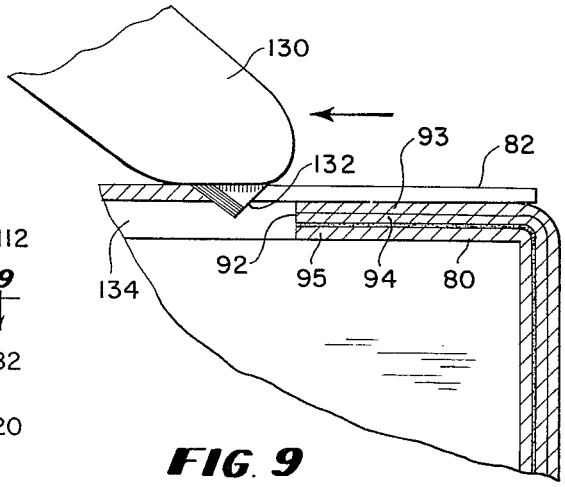
FIG. 9

SHIPPING CASE

BACKGROUND OF THE INVENTION

This invention relates to a special shipping case for elimination of cut carton contents upon opening the case for price marking and stacking of the cartons on the store shelf, for example.

Considerable problems have been encountered in connection with inadvertent cutting of ready-to-eat cereal boxes and the like, for example, by store clerks when shipping cases are opened for price marking of the contents. Knives having a short blade of pre-set length are customarily used for this. Typically, the clerk will run the knife blade along two ends and a side of a case immediately below the top of the case in order to pivot the top open, and in some instances, the top of the case is severed entirely. A long standing problem has been the fact that cartons adjacent an outer wall of the case are likely to be cut. In recent investigations of this problem, it has been observed in laboratory tests that from 15 to 40 percent of the vulnerable cartons, that is, cartons immediately adjacent the outside of the shipping case, were cut or damaged by the store clerk's knife during removal of the shipping case top in preparation of price marking of the contents.

This problem has been found to have become particularly aggravated during the present trend towards higher density cereal products. While I do not intend to be bound by any theories of operation in connection with this invention, it is my belief, based on repeated observation, that in many instances a small gap has been provided by the manufacturer between a top of a shipping case and the top of the content cartons. If the store clerk where to draw the opening knife along the outside of a shipping case in that top portion thereof which corresponds to the small gap between the top of the contents and the top of the shipping case, it is apparent that no substantial damage would occur to the contents of the case. However, it has been learned that upon stacking of cases on pallets, and upon stacking of loaded pallets on top of one another for storage, the weight forces involved generally result in the collapse of the small gap between the top of the content cartons and the top of the shipping case. This is particularly exaggerated in those instances involving a relatively high density product as, for example, a high density natural ready-to-eat cereal as distinguished from a low density puffed ready-to-eat cereal. When the clerk draws the knife along the outside of the shipping case, regardless of how close to the top of the case the blade stays, the knife will probably, and in fact does, damage a large percent of the vulnerable content containers using heretofore available shipping cases.

SUMMARY OF THE INVENTION

The store-cut damage to shipping case carton contents is substantially eliminated by providing corrugated board shipping assembly in accordance with the present invention.

In accordance with a preferred aspect of the present invention, the tops of the shipping case contents are arranged within a shipping case to be adjacent a top panel of the case, the top panel of the case having flaps dependent along at least three edges thereof. These flaps, in accordance with the present invention, depend from the top panel over the outside of the body of the case, and are free from attachment to the underlying body of the shipping case along an elongated zone adjacent the edge of the top panel. The dependent flaps are secured, for example, by glueing, to the body of the case beyond the attachment-free zone. Upon opening the case in accordance with the present invention, the drawing of the knife through the dependent flaps in the attachment-free zone along three edges of the top panel severs the top panel from the remaining portions of the dependent flaps which secure the top panel in a shipping configuration, permitting the top panel to be hinged upwardly for price marking for the cartons inside, for example. If desired, the top panel can be totally severed by cutting through the top panel along the hinged side from the inside face of the top panel with no risk whatsoever to the contents. In accordance with the present invention at least one of the dependent flaps is provided by an S fold of the corrugated material along the top of one of the side panels of the case immediately adjacent the top panel. In accordance with a particularly preferred embodiment of the present invention all four edges of the top panel are provided with the outer dependent flaps which can be severed without disruption or damage to the contents.

The invention will be described in general with the aid of particularly preferred embodiments by means of the following description and drawings in which:

FIG. 6 is a fragmentary elevational side view taken approximately through the line 6—6 in FIG. 2.

FIG. 7 is a fragmentary end view of the partially assembled containers shown in FIG. 2.

FIG. 8 is a fragmentary plan view of a partially assembled blank for assembling the case shown in FIG. 2.

FIG. 9 is a fragmentary sectional plan view taken approximately along the line 9—9 in FIG. 6.

FIG. 10 is a perspective view of an alternative embodiment in accordance with the present invention.

FIG. 11 is a fragmentary elevational sectional view taken approximately along the line 11—11 in FIG. 2.

FIG. 12 shows the same structures illustrated in FIG. 11 with some components in a moved position.

Figure 1:
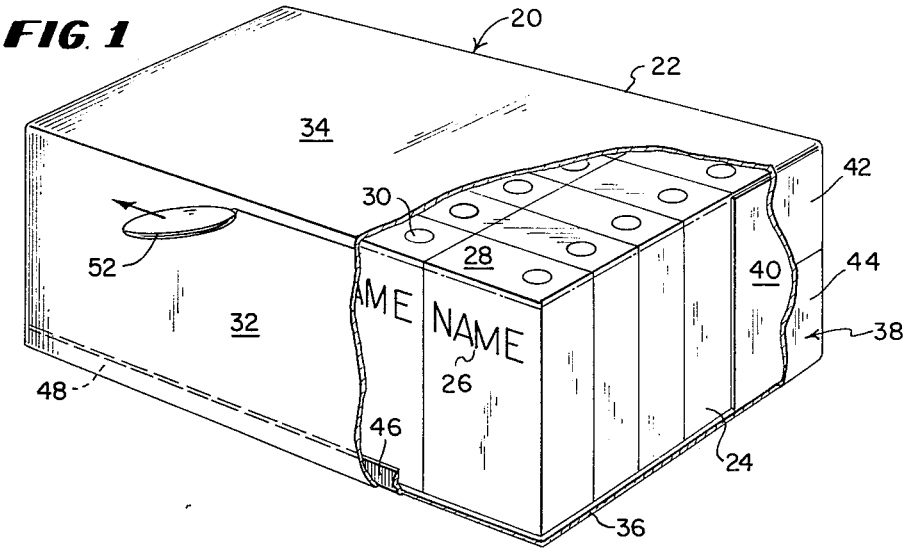
FIG. 1 is a perspective cut-away view of the shipping assembly in accordance with the "prior art".

FIG. 1 is intended to illustrate the typical and very widely used structure in accordance with the prior art. A shipping assembly is generally indicated by the numeral 20 and includes a shipping case 22 having a plurality of packages 24 packed therein. It is noted that packages 24 normally have indicia 26 imprinted thereon, and that indicia 26 determines that one end 28 of package 24 is designated as the "top" of package 24. Typically indicia is also provided at the top end 28 to facilitate price marking and price checking of the merchandise, namely packages 24.

Shipping case 22 is typically manufactured from a corrugated paper board blank and includes a front panel 32, top panel 34, a rear panel (not shown) and a bottom panel 36. Each end wall generally indicated by the numeral 38 is made up of a pair of minor end flaps 40 folded and integrally hinged from the front panel 32 and from the rear panel (not shown), and a pair of major end flaps 42, 44. A glue lap flap 46 is integral with and hinged to bottom panel 36 and is glued along a glue lap 48 to the "bottom" of front panel 32. Thus, in accordance with the prior art, glue lap 48 is situated along the "bottom" end of packages 24 and on the inside of front panel 32. A single layer of corrugated paper board covers packages 24 at the top thereof at the top portion of panel 32 which is normally cut by the clerk's knife 52, for example. Upon opening of the case 22 with the knife 52 as indicated in FIG. 1 it has been discovered that packages 24 which are adjacent to front panel 33 and rear panel 34 are virtually certain to be damaged by the store clerk's knife 52. This damage typically results in a slash 54 in the face of one or more of the packages 24.

Typically the store clerk's will place packages 24 on the store shelves and in many instances the damaged cartons are purchased, reluctantly by the consumer. In an increasing number of instances, however, the consumer refuses to purchase store-cut packages, and, in the absence of any good shipping assembly which eliminates the likelihood of store-cut cartons, reputable manufacturers, being sympathetic with the difficult position in which the store is placed, tend to have policies favoring the buying back of store-cut and otherwise damaged merchandise from the store. This is a waste of resources, time, effort and material and constitutes an undesirable cost factor borne ultimately by all of the consumers.

From the following description of the shipping assembly in accordance with the present invention, and from a comparison of actual test data, it is appreciated that the shipping assembly in accordance with the present invention substantially eliminates the store-cut package problem.

In the following detailed description of the figures two preferred embodiments will be discussed. A first preferred embodiment is illustrated by means of FIGS. 2–9 inclusive, and a second preferred embodiment is illustrated with the aid of FIGS. 10–12. The differences between the embodiments shown in FIGS. 2 and 10 relate to differences in the S fold which will be discussed hereinafter in detail, and, for the sake of simplicity and clarity of description, parts and components of the shipping assembly shown in FIG. 2 which are identical to parts and components of the shipping assembly shown in FIG. 10 will be identified by the same numeral in each instance.

In the figures, a first preferred embodiment of the invention is illustrated by a shipping assembly generally indicated by the numeral 60 (FIG. 2) and a second embodiment of the present invention is illustrated in the shipping assembly generally indicated by the numeral 62 (FIG. 10).

Figure 2:
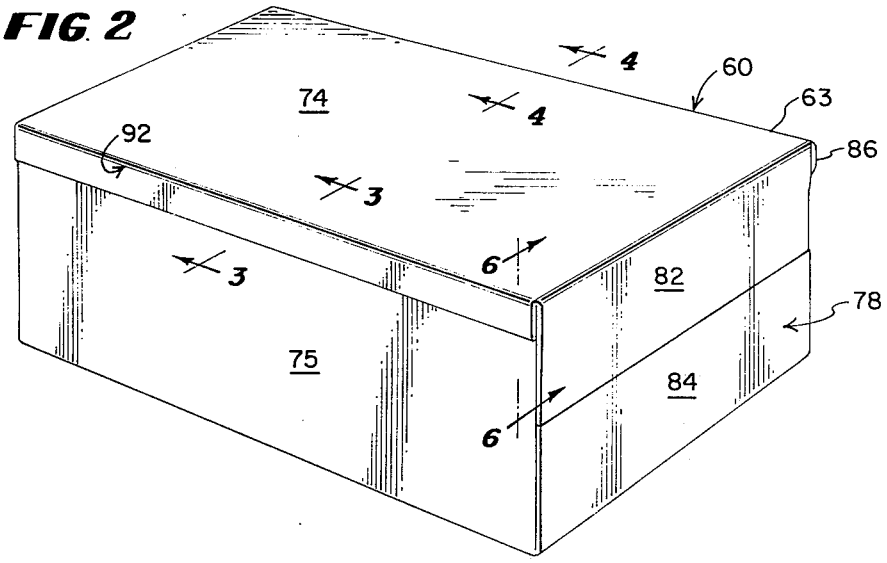
FIG. 2 is a perspective view of a shipping assembly in accordance with the present invention.

In FIG. 2 a shipping assembly in accordance with the present invention comprises shipping case 63 having a plurality of packages identical to packages 24 contained therein. The packages contained in case 63, in accordance with the present invention also include indicia 26 thereon which results in one end of the packages being regarded as the top. Case 63 comprises a front panel 72, top panel 74, rear panel 75 and bottom panel 76.

The end walls of case 63 are generally indicated by the numeral 78. End walls 78 respectively each comprise a pair of minor end flaps 80, 81, top major end flaps 82 and bottom major end flaps 84. A glue lap flap

Figure 4:
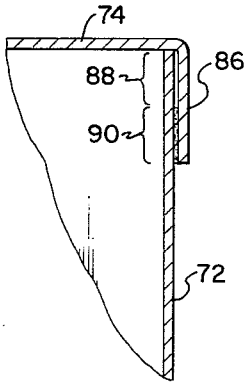
FIG. 4 is a fragmentary elevational sectional view taken approximately through the line 4—4 in FIG. 2.

86 which is integral with and hinged to top panel 74, in the assembled carton, overlays the top edge of front panel 72 and is secured thereto (see FIG. 4). However, in accordance with a preferred aspect of the present invention, the glue lap flap 86 is not secured to front panel 72 along the top marginal zone 88 and is secured by glue, for example, along zone 90 which is parallel to and below or beyond zone 88. Zone 88, therefore, is positioned between attachment zone 90 and top panel 74. The width of unattached zone 88 is not critical but it is preferred that it extend at least ¼ inch and preferably ½ inch to 5/8 inch from the bottom of top panel 74.

In FIG. 8 a portion of a blank 100 is shown in partially assembled condition. The cases, 60, 62 are assembled from a single blank.

It is essential in accordance with the present invention that top panel 74 be secured to rear panel 75 throughout the S fold which is generally indicated by the numeral 92 in FIGS. 2–9 and by the numeral 92' in FIGS. 10–12. Referring specifically to respective FIGS. 3 and 11, it is apparent that the S folds namely, 92, 92' include an outermost leg 93, 93', a middle leg 94, 94' and an innermost leg 95, 95', respectively. It is also apparent from consideration of FIGS. 3 and 11 that middle legs 94, 94' respectively are glued to innermost legs 95, 95', respectively in glue zones 96, 96' respectively. In the embodiment illustrated in FIG. 3, top panel 94 is continuous with the integral with outer leg 93, whereas in the embodiment illustrated in FIG. 11, top panel 74 is continuous with an integral leg 92'.

Figure 3:
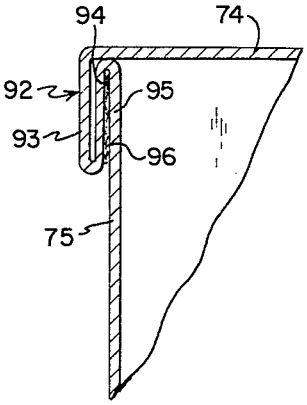
FIG. 3 is a fragmentary cross-section elevational view taken approximately along the line 3—3 of FIG. 2.

It will also be appreciated from a consideration of FIGS. 3 and 11 that outermost fold legs 93, 94' are unattached to the abutting face of the opposing middle fold legs 94, 94' of the S fold 92, 92'. It will be appreciated that this is essential in accordance with the present invention to achieve the separation of top panel 74 from rear panel 75. To remove top panel 74, a knife is drawn through outermost legs 93, 93' and through the top edge of major end flaps 82, and top panel 74 is pivoted upwardly thereby resulting in the configuration illustrated in FIGS. 5 and 12.

Figure 5:
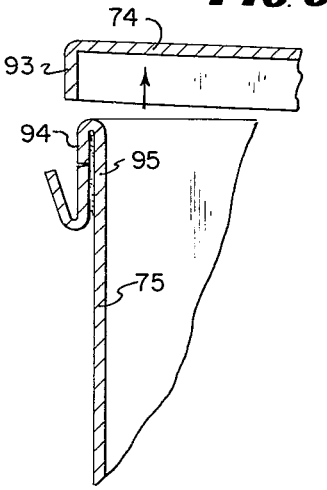
FIG. 5 is a fragmentary elevational sectional view of the portion of the structure shown in FIG. 2 with components in a moved position.

Thus, the functions of S fold 92, 92' are substantially identical even though leg 93 is part and integral with rear panel 75 in the embodiment shown in FIG. 11, whereas the outermost leg 93, in the embodiment shown in FIG. 5 is integral with top panel 74.

Referring now specifically to FIG. 8, a portion of a partially assembled blank utilizing the present invention is generally indicated by the numeral 100. In FIG. 8, top panel 74, rear panel 75, minor end flap 80, and major end flap 82 are shown and these portions are delineated by score lines 102 and 104. In the illustrated configuration a flattened S fold 92 has already been incorporated and is pressed in the partially assembled structure as shown in FIG. 8. Slit 106 has been cut to separate S fold 92 at the end portion 112 thereof from major end flaps 82.

During further assembly of the partially assembled blank 100 the configuration shown in FIG. 7 results, in which end portion 112 of the S fold 92 is folded with minor end flap 80 to underlay major end flap 82 after end flap 82 is folded downwardly over minor end flap 80 in the configuration illustrated in FIG. 6. It is noted that it is essential in accordance with the present invention that respective top major end flaps, 82, 82' be free of attachment in the upper portion 116 thereof and that it be secured to the respective minor end flaps 80 at glue zone 120, for example, below unattached zone 116.

The presence of end portion 112 of S fold between minor end flap 80 and major end flap 82 increases the spacing between major end flap 82 and the contents of the package, for example, cartons 24. This is illustrated in FIG. 9 in which a knife 130 having a relatively short fixed-length blade 132 is shown cutting through major end flap 82, and incidentally, through part of outermost leg 93 of the S fold 92 and marginal portion 112 thereof. It will be appreciated from consideration of FIG. 9 that the presence of the S fold end portion 92 helps assure the wide gap 134.

Considered from one viewpoint, the present invention provides a shipping case assembly for facilitating removal of the shipping case top for price marking of content containers of said assembly, in which the corrugated paperboard shipping case 63 has a top panel 74 having major end flaps dependent therefrom and overlaying the end walls of the case, the end flaps being free of attachment to the underlaying end walls at the top marginal portion thereof along an elongated zone of non-attachment immediately adjacent the connection between the major end flaps and the top panel, said end flaps being attached to the end walls of the container in a zone below the zone of non-attachment, and wherein the top panel 74 is connected to a side panel 75 through an S fold 92 in which the outermost leg 93, 93' of S fold 92 is unattached at the face thereof opposing the middle leg 94, 94'. Thus, in accordance with this broad aspect of the present invention the shipping assembly comprises the structure and configuration in which the content packages have indicia imprinted thereon whereby one end of the packages are designated as the top thereof and in which the top of the content packages are positioned adjacent the top panel 74 of the case 63. In accordance with this aspect of the present invention the end panels major end flaps 72 can be severed adjacent the top panel 74 thus separating the connection between top panel 74 and the end walls generally 78, 78' and along the length of S fold 92 drawing a knife e.g., 130 through outermost fold 92, 93, 93' severs the connection of top panel 74 with the adjacent side panels 75. Thus the top panel is severed along end flaps 82 and S fold 92, freeing top panel 74 along the entirety of three edges thereof, whereby top panel 74 can be hinged upwardly.

In the preferred embodiment of the present invention the glue lap flap 86 can also be severed by drawing a knife e.g., 130 through the glue lap flap 86 and non-attached zone 88 thereby totally liberating the top panel 74 from the remaining portions of case 63. Alternatively, the optional glue lap flap 86 need not be provided and the top panel 74, liberated along three sides thereof, in accordance with the present invention, can be lifted upwardly and severed from the remaining portion of the body 63 by cutting through panel 74 with knife 130 along the inside thereof through the remaining hinge attachment to body 63.

The present invention substantially eliminates the cutting of content cartons 24 upon severing of the top panel 74 from the remaining portion of case 63.

I claim:

1. A shipping assembly for facilitating store-cut removal of shipping case tops for price marking of content containers, and for substantially eliminating store-cut damage to containers, said assembly comprising:

a corrugated board shipping case comprising a top panel and having a plurality of containers packed therein; each of said containers having indicia imprinted thereon establishing a top and a bottom of the respective containers, said containers being arranged within said shipping case with the tops of said containers being adjacent the top panel of said shipping case; flaps dependent from said top panel of the shipping case along at least three edges thereof; an opposing pair of said flaps dependent from opposite edges of said top panel free of attachment to the body of the case along an unattached marginal zone along an edge thereof adjacent the top panel, said pair of flaps being secured to the body of the case below the marginal zone, and an intervening edge of said top panel between said opposing flaps being attached to a side panel of said shipping case through a flat S fold thereof in which an outermost leg of the S fold is unattached to an abutting face of a middle leg of the S fold.

2. The shipping assembly of claim 1 in which said side panel has minor end flaps extending from both ends thereof, and in which said S fold extends along the top of said minor end flaps, and in which an end portion of the S fold resides between the minor end flaps and the major end flaps.

3. The shipping assembly of claim 1 in which the fourth edge of the top panel opposite said intervening edge is connected to the other side panel of the shipping assembly by means of an overlaying glue lap flap integral with said top panel, said overlaying end flap being free of attachment to the other side panel along a marginal zone extending along the entire top portion thereof immediately adjacent said top panel, said glue lap flap being attached to the other side panel along a zone below said marginal zone.

4. A shipping assembly for facilitating store-cut removal of shipping case tops for price marking of content containers, and for substantially eliminating store-cut damage to the containers, said assembly comprising:

a corrugated board shipping case comprising a top panel and having a plurality of containers packed therein; each of said containers having indicia imprinted thereon establishing a top and a bottom of the respective containers, said containers being arranged within said shipping case with the tops of said containers being adjacent of said top panel of said shipping case; at least three flaps dependent from said top panel along at least three edges thereof; said flaps being free of attachment to the body of the case along an unattached marginal zone adjacent the edge of the top panel, said flaps being secured to the body of the case below said unattached marginal zone, wherein a middle flap is provided by the outermost fold in a "S" fold connecting the top panel and a respective adjacent side panel, and wherein said outermost fold is not attached to the abutting face of the underlaying middle leg of the S fold.

5. A tubular, partially assembled, corrugated shipping container blank comprising a top panel, bottom panel, and a pair of side panels, each of said panels being delineated by respective score lines; said top panel being secured to at least one of said side panels by means of a flat S fold in said side panel, said S fold comprising an outermost leg, a middle leg, and innermost leg of corrugated material, said outermost leg of the S fold being unattached to the abutting face of said middle leg of the S fold.

6. The tubular, partially assembled, corrugated, blank shipping container of claim 5 including respective minor end flaps extending from both ends of said side panels and delineated therefrom by score lines therebetween, major end flaps extending from both ends of said top and bottom panels and being delineated therefrom by respective score lines, and wherein said S fold extends along the edge of the adjacent minor end flap destined to be adjacent said top panel upon complete assembly of the shipping case.

7. The tubular, partially assembled, corrugated, blank shipping case of claim 5 having a glue lap flap at the edge of the top panel which is opposite an edge thereof adjacent said S fold, said glue lap flap being delineated from said top panel by a score line between said glue lap flap and said top panel, said glue lap flap overlaying a portion of the other side panel, said glue lap flap being unattached to said other side panel along a zone adjacent said glue lap flap score line and secured to said front panel beyond said zone.

* * * * *